US005606818A

United States Patent [19]

Hardee

[11] Patent Number: 5,606,818

[45] Date of Patent: Mar. 4, 1997

[54] MULTI-PURPOSE AMBIDEXTROUS RIFLE SCOPE MOUNT

[76] Inventor: Timothy G. Hardee, 2262 McGowan Pkwy., Marysville, Calif. 95901

[21] Appl. No.: 426,267

[22] Filed: Apr. 21, 1995

[51] Int. Cl.[6] ..... F41G 1/38

[52] U.S. Cl. ..... 42/101; 42/100; 42/103

[58] Field of Search ..... 33/245, 250; 42/100, 42/101, 103

[56] References Cited

U.S. PATENT DOCUMENTS

| | | | |
|---|---|---|---|
| 3,737,232 | 6/1973 | Milburn, Jr. | 33/245 |
| 3,834,052 | 9/1974 | Steck, III | 42/13 |
| 4,769,938 | 9/1988 | Chestnut et al. | 42/101 |
| 5,033,219 | 7/1991 | Johnson et al. | 42/101 |
| 5,134,798 | 8/1992 | Lee | 42/101 |
| 5,343,650 | 9/1994 | Swan | 42/100 |

OTHER PUBLICATIONS

Webster's II New Riverside University Dictionary, "sight", site, pp. 1082–1083, 1087. 1984.

Defense Procurement Manufacturing Services (DPMS) catalog, vol. 6, (date unknown), p. 42.

*Primary Examiner*—Charles T. Jordan
*Assistant Examiner*—Meena Chelliah
*Attorney, Agent, or Firm*—Bradley P. Heisler

[57] ABSTRACT

A scope mount is provided for a rifle which allows multiple scopes to be simultaneously attached to the rifle. The scope mount includes a connector which is rigidly attachable to a rifle base affixed to a receiver of the rifle. The scope mount also includes an auxiliary base rigidly attached to the connector and spaced to a side of the connector. The auxiliary base has a contour similar to a contour of the rifle base. Hence, any scope which is attachable to the rifle base directly can be similarly attached to the auxiliary base. The connector of the scope mount has a length which is shorter than a length of the rifle base. The connector can be connected to the rifle base and leave remaining portions of the rifle base exposed for connection of a scope thereto. A second scope can then be connected to the auxiliary base of the scope mount without necessitating removal of the scope which is attached directly to the rifle base. Thus, two scopes or other objects can be connected to the rifle. The mount is reversible to allow a second scope to be located on either a left side or right side of the rifle.

19 Claims, 4 Drawing Sheets

MULTI-PURPOSE AMBIDEXTROUS RIFLE SCOPE MOUNT

FIELD OF THE INVENTION

The following invention relates to rifles and scope mounts for rifles. More specifically, the following invention relates to mounts for a rifle base commonly known as a Steneg-Weaver base which facilitate attachment of multiple scopes and other items to the Steneg-Weaver base of the rifle simultaneously.

BACKGROUND OF THE INVENTION

Rifles have long included sights and scopes for accurate aiming of the rifle at a target. Various different scopes have been developed which have different purposes. High-power scopes have been developed for accurate aiming of the rifle at targets a long distance away. Short-range scopes have been developed which provide accurate aiming of the rifle on targets which are closer to the rifle. These scopes are generally attached to the rifle in a readily detachable and replaceable manner, such that various different scopes can be interchangeably connected to the rifle depending on the needs of the user. To facilitate the secure and precise attachment of different scopes, rifles have been commonly configured to include a base on an upper surface of a receiver of the rifle which has become a standard for attachment of many different types of rifles scopes. This rifle base, referred to as Steneg-Weaver base or Weaver base, is limited in that it only allows attachment of one scope to the rifle at a time.

In many environments, a user has need for a rifle with more than one scope. For instance, a hunter is not aware when choosing a scope for the rifle whether game will be encountered at short range or long range. Additionally, targeting sports have proliferated which, in order to test both the long range and short range abilities of the sportsman, include both short range and long range targets. It is impractical for a user to switch scopes, which are attached to the Weaver base, in the middle of one of these competitions. Similarly, it is impractical for a user to utilize two separate rifles, one having a long range scope and a second having a short range scope for a single competition. Hence, a need exists for a mount which allows a scope to be attached to a rifle through the Weaver base without interfering with the attachment of another scope already attached to the Steneg-Weaver base. With such a multi-scope system, a user could merely choose the desired scope to utilize when aiming at targets of varying distances.

SUMMARY

This invention provides a multi-purpose ambidextrous rifle scope mount which allows a second scope to be attached to a rifle having a Steneg-Weaver type rifle base affixed thereto. Steneg-Weaver bases, also called Weaver bases, are fixed to a receiver of many types of rifles, particularly assault-type rifles. The Weaver base provides an attachment surface to which various types of scopes can be connected. The Weaver base includes a plurality of grooves oriented perpendicular to a long axis of the Weaver base and spaced from each other by teeth. The grooves extend across the Weaver base a full width of the Weaver base to sides of the Weaver base. Side lips are oriented on each side of the Weaver base.

Scopes are attached to the Weaver base through scope rings which have a recess which mirrors a portion of the attachment surface of the Weaver base. Ring clamps are provided which allow for attachment and detachment of the scope ring to the Weaver base, attaching and detaching the scope to the Weaver base.

The rifle scope mount of this invention includes a connecter which has a contour similar to that of the recess of the scope rings and complemental to the attachment surface of the Weaver base. Additionally, the scope mount of this invention includes an auxiliary base attached to the connector. The auxiliary base is configured to have a coupling surface similar to the attachment surface of the Weaver base. The connector is sized to allow its connection to the Weaver base even when a scope is already connected to the Weaver base. With the connector coupled to the Weaver base, the auxiliary base is held rigidly to the Weaver base through the connector. Hence, a second scope can be connected to the auxiliary base, instead of directly to the Weaver base while another scope is connected directly to the Weaver base. This invention thus allows multiple scopes to be connected to the Weaver base, one connected directly to the Weaver base and another connected to the auxiliary base which is connected to the Weaver base through the connector.

Because the auxiliary base is configured to be similar to the Weaver base, nearly any scopes or other objects which are designed to connect directly to the Weaver base can be similarly connected to the auxiliary base of the scope mount of this invention. Hence, the multi-purpose ambidextrous rifle scope mount of this invention facilitates the coupling of more than one accessory, such as a scope, to the rifle simultaneously through the Weaver base which would otherwise be capable of only supporting a single scope or other object.

Accordingly, a primary of the present invention is to provide a scope mount which can be attached to a portion of a Weaver base on a rifle, the mount connectable to the Weaver base while a scope is simultaneously connected directly to the Weaver base, the mount having an auxiliary base coupled to the connector which is similar to the Weaver base and can support a second scope thereon. Another object of the present invention is to allow a rifle user to simultaneously couple more than one object, such as a scope, to a Weaver base without hindering performance of the rifle.

Another object of the present invention is to provide a scope mount which can couple a scope to a rifle in an orientation which is precisely oriented with respect to a barrel of the rifle, such that the scope can provide accurate alignment of the rifle for effective targeting. Another object of the present invention is to provide a rifle scope mount which connects to a Weaver base on a rifle without obstructing another scope already coupled to the Weaver base.

Another object of the present invention is to provide a rifle scope mount which is light weight and formed from durable materials such that an overall weight increase for the rifle is negligible and the rifle scope mount provides reliable, accurate performance. Another object of the present invention is to provide a rifle scope mount which has a design which facilitates its manufacture utilizing a variety of different efficient machining and manufacturing methods.

Another object of the present invention is to provide a means to (selectively attach and detach the connector of the mount to the Weaver base,) such that when the scope mount is connected to the Weaver base it is rigidly aligned for accurate scope support and can be readily disconnected when not needed. Another object of the present invention is to provide an auxiliary base attached to a Weaver base in a position which allows a second scope to be connected to the auxiliary base without interference with a scope attached directly to the Weaver base and without causing any interference with loading or ejection of shells fired by the rifle or obstruction of any other moving parts of the rifle.

In addition to the above recited objects, various additional objects will become apparent from a careful reading of the specification and claims provided herein as well as the included drawing figures.

DESCRIPTION OF THE PREFERRED EMBODIMENT

Figure 1:
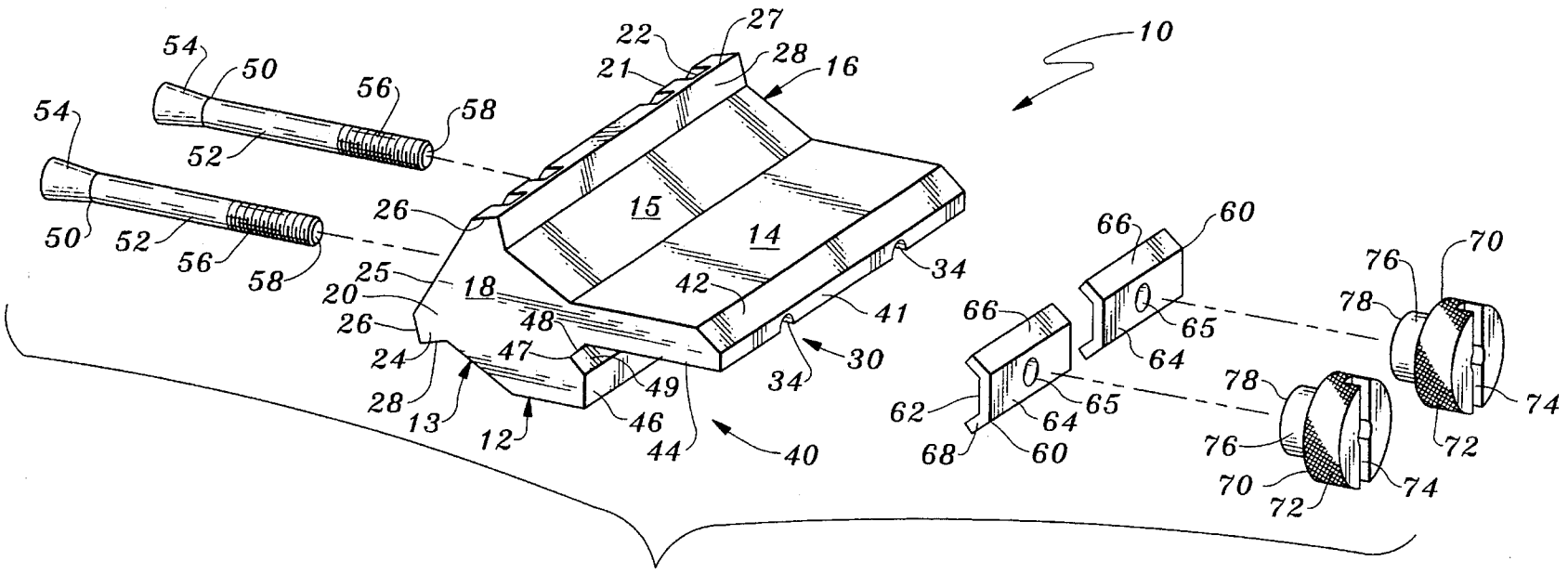
FIG. 1 is a perspective view of the multi-purpose ambidextrous rifle scope mount of this invention with separately formed portions thereof shown exploded away from each other.

With reference now to the drawing figures, wherein like reference numerals represent like parts throughout, reference numeral 10 is directed to a multi-purpose ambidextrous rifle scope mount. The scope mount 10 is connectable to a Steneg-Weaver type base 80, also called a Weaver base 80, attached to a rifle 2 through a connector 40 of the scope mount 10 (FIGS. 5 through 10). The scope mount 10 provides an auxiliary base 20 which has a shape similar to that of the Weaver base 80. Thus, a kit is provided which modifies the rifle 2 to allow attachment of two scopes to the rifle 2 simultaneously.

Figure 2:
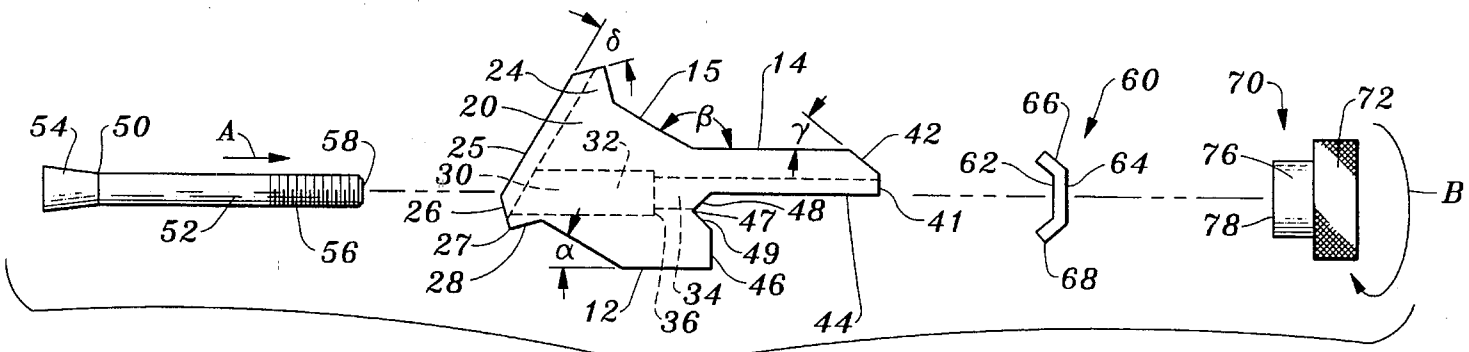
FIG. 2 is a rear view of this invention with interior details thereof shown with hidden lines and with separately formed portions thereof exploded away from each other.

In essence, and with reference to FIGS. 1 and 2, the scope mount 10 is a rigid unitary mass of material which is juxtaposed between the Weaver base 80 on one side and an auxiliary scope 110 (FIGS. 8–10) on an opposite side. The scope mount 10 is connected to the Weaver base 80 through a connector 40. The connector 40 has a contour which mirrors a contour of an attachment surface 85 of the Weaver base 80. A pair of bolts 50 extend from a side of the connector 40 and support a pair of clamp plates 60 and nuts 70 thereon. When the connector 40 is oriented overlying the attachment surface 85 of the Weaver base 80, the clamp plate 60 can be tightened against the Weaver base 80 by tightening of the nut 70, causing the connector 40 to rigidly connect to the Weaver base 80.

An auxiliary base 20 forms a portion of the scope mount 10 adjacent the connector 40 and rigidly formed with the connector 40. The auxiliary base 20 has a coupling surface 25 which has a contour which mirrors the contour of the attachment surface 85. Hence, nearly any scope or other object which is connectable to the Weaver base 80 can be similarly coupled to the auxiliary base 20 of the scope mount 10. When the connector 40 of the scope mount 10 is rigidly connected to the Weaver base 80, the auxiliary base 20 is provided in an orientation which is aligned with a barrel 8 of the rifle 2 in a manner similar to an orientation of the Weaver base 80. Hence, a scope can be equally effective whether connected directly to the Weaver base 80 or connected to the auxiliary base 20. More particularly, and with specific reference to FIGS. 1–4, details of the scope mount 10 and its auxiliary base 20 are described in detail. The scope mount 10 is preferably a rigid unitary mass machined from a lightweight material such as aluminum. The scope mount 10 includes a planar lower surface 12 spaced from and parallel to an upper surface 14. Both the lower surface 12 and upper surface 14 extend between a front end 16 and rear end 18. Both the front end 16 and the rear end 18 are planar and are oriented parallel to each other. Preferably, a distance between the front end 16 and rear end 18 is limited to a length less than a length of the Weaver base 80 (FIG. 5) such that the scope mount 10 can be connected to the Weaver base 80 with remaining portions of the Weaver base 80 exposed for simultaneous attachment of other objects thereto.

Figure 3:
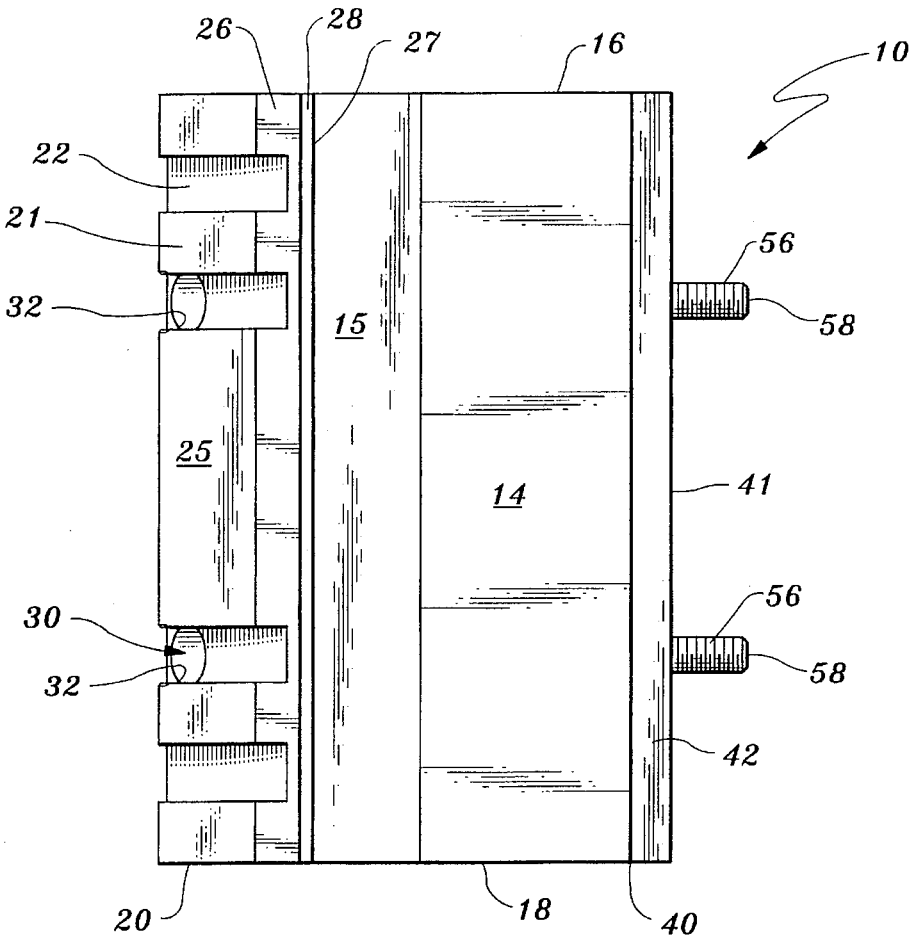
FIG. 3 is a top view of this invention with clamp plates and nuts removed.

The auxiliary base 20 is shown in FIGS. 1–3 as extending from a left side of the scope mount 10. However, the auxiliary base 20 could alternatively be oriented on a right side of the scope mount 10 so long as the connector 40 is similarly reversed. The auxiliary base 20 is oriented with the coupling surface 25 non-parallel to the lower surface 12 and upper surface 14 and perpendicular to the front end 16 and rear end 18.

A lower slant 13 forms a surface of the scope mount 10 which extends between the lower surface 12 and one side of the auxiliary base 20. An upper slant 15 extends between the upper surface 14 and an opposite side of the auxiliary base 20. The lower slant 13 and upper slant 15 are preferably parallel to each other and oriented in planes which are perpendicular to the front end 16 and rear end 18 and non-parallel with respect to the lower surface 12 and upper surface 14.

Preferably, the lower surface 12 and lower slant 13 are oriented in planes which diverge from each other by an angle $\alpha$ of approximately 30°. Preferably, the upper slant 15 is oriented in a plane which diverges from a plane including the upper surface 14 by an angle $\beta$ of approximately 150°. While these angles provide the upper slant 15 and lower slant 13 parallel to each other, other angles could similarly be selected for the upper slant 15 and the lower slant 13 which would still provide the slants 13, 15 parallel to each other. For instance, if the angle $\alpha$ is 0° and the angle $\beta$ is 180°, the auxiliary base 20 would be oriented with its coupling surface 25 substantially perpendicular to both the lower surface 12, upper surface 14, front end 16 and rear end 18. If the angle $\alpha$ is 90° and the angle $\beta$ is 90° then the auxiliary base 10 would be oriented with a planar portion of the coupling surface 25 substantially parallel to the upper surface 14 and lower surface 12 and perpendicular to the front end 16 and rear end 18.

It has been found that when the angle α is approximately 30° and the angle β is approximately 150° the coupling surface 25 of the auxiliary base 20 is positioned such that a scope can be easily connected thereto without obstructing any of the moving parts of the rifle 2 (FIG. 5) and provide an auxiliary scope 110 (FIGS. 8–10) in a position in which it can be readily and easily utilized by a user of the rifle 2. In this preferred orientation, the coupling surface 25 exhibits an angle of approximately 60° from parallel with the upper surface 14.

The coupling surface 25 of the auxiliary base 20 is substantially planar with a plurality of grooves 22 oriented thereon. Each groove 22 is of substantially rectangular cross section and oriented extending in a plane substantially parallel to adjacent grooves 22 and parallel to the front end 16 and the rear end 18 of the scope mount 10. A mount tooth 21 is located between each groove 22. Preferably, each mount tooth 21 is substantially rectangular in cross section and extends between sides of the auxiliary base 20. Preferably, two grooves 22 are oriented closest to the rear end 18 and two grooves 22 are located closest to the front end 16 with no other grooves 22 on the auxiliary base 20. Alternatively, grooves 22 can be formed continuously from the front end 16 to the rear end 18 with one mount tooth 21 oriented between each groove 22.

Preferably, each groove 22 is of a similar cross section and exhibits a width between adjacent mount teeth 21 similar to a spacing from adjacent grooves 22, such that the mount teeth 21 have a size similar to a size of each groove 21. The grooves 22 provide clearance for bolts 50 which are utilized by objects such as the auxiliary scope 110 (FIGS. 8–10) to connect scope rings 112 to the auxiliary base 20.

A mount lip 24 is oriented on each side of the auxiliary base 20, between the coupling surface 25 and the upper slant 15 on one side and between the coupling surface 25 and the lower slant 13 on an opposite side. Each mount lip 24 is substantially triangular in cross section with an upper surface 26 extending from a planar portion of the coupling surface 25 to an edge 27 and a lower surface 28 extending between the edge 27 and either the lower slant 13 or the upper slant 15. The upper surface 26 of each mount lip 24 is oriented in a plane which diverges from a planar portion of the coupling surface 25 by an angle δ of preferably 45°. The upper surface 26 preferably forms a right angle with the lower surface 28, such that the edge 27 defines a junction between the upper surface 26 and lower surface 28 at 90°.

Figure 8:
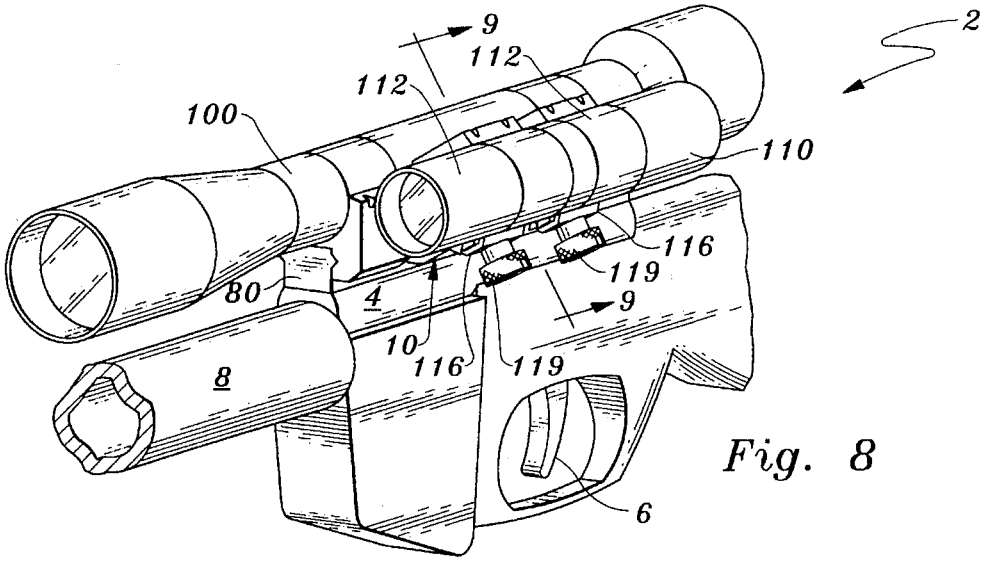
FIG. 8 is a perspective view of that which is shown in FIG. 7 with an auxiliary scope coupled to the rifle scope mount of this invention.
Figure 9:
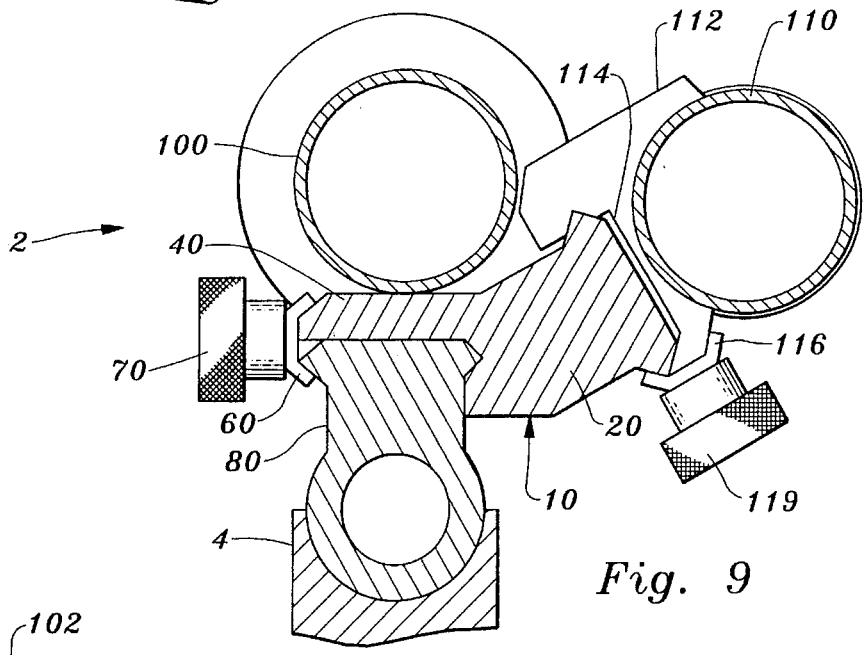
FIG. 9 is a sectional view taken along line 9—9 of FIG. 8.
Figure 10:
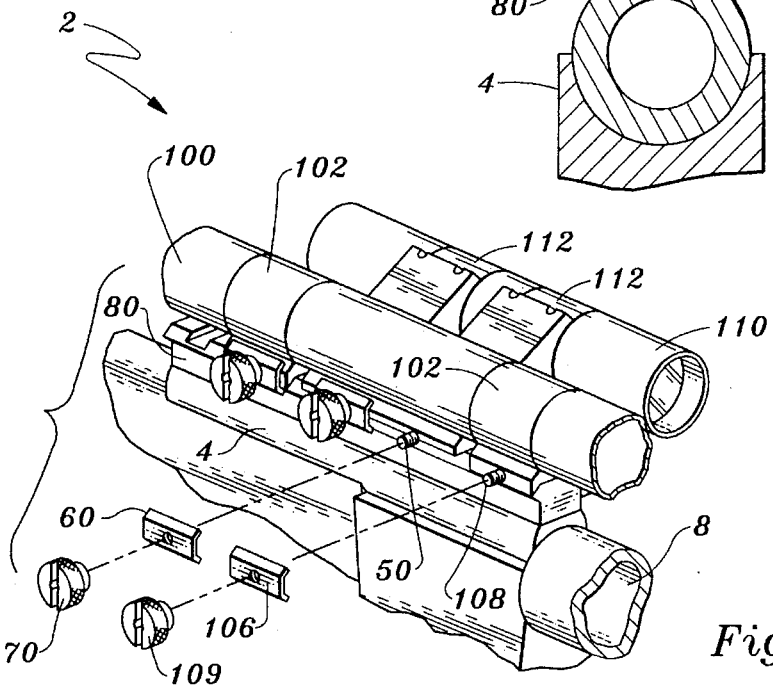
FIG. 10 is an alternative perspective view of that which is shown in FIG. 8 revealing details of how the high power scope and auxiliary scope are simultaneously coupled to the Steneg-Weaver base.

The coupling surface 25 extends in a planar fashion for a width similar to a distance between the lower slant 13 and upper slant 15. Hence, the mount lips 24 extend out away from each other at a width greater than a distance between the lower slant 13 and upper slant 15. While a majority of the coupling surface 25 is planar between the upper surfaces 26 of the two mount lips 24, the coupling surface 25 can be considered to include the mount lips 24. Hence, the coupling surface 25 extends beyond its planar portion to include the two mount lips 24 which also provide for coupling, such as that exhibited with the scope rings 112 of the auxiliary scope 110 (FIGS. 8–10).

Figure 5:
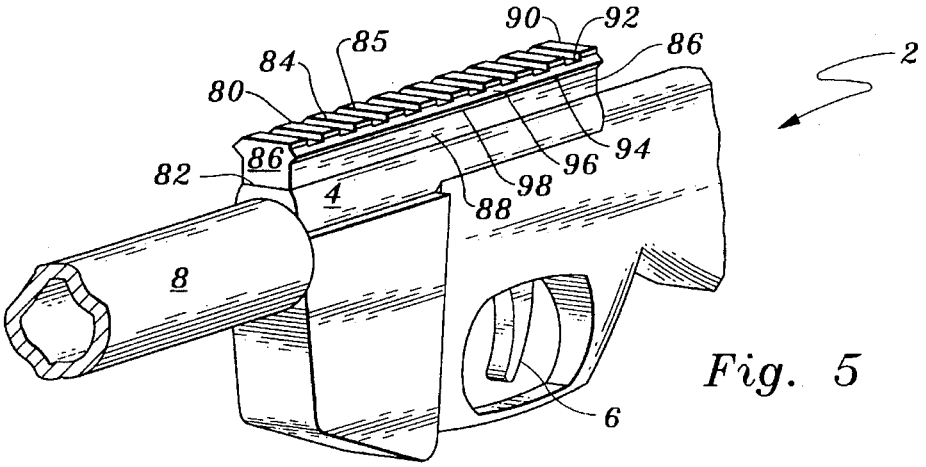
FIG. 5 is a perspective view of a rifle having a Steneg-Weaver type rifle base affixed to a receiver of the rifle.

In essence, the auxiliary base 20 is preferably identical to the Weaver base 80 except that the length and the number of grooves 22 provided in the auxiliary base 20 is preferably less than the number of grooves 92 located in the Weaver base 80 (FIG. 5). The Weaver base 80 includes a bottom 82 which attaches to a receiver 4 of the rifle 2 which is directly behind the barrel 8 of the rifle 2 and above the trigger 6 of the rifle 2. The bottom 82 is typically connected to the receiver 4 in a permanently affixed manner by a skilled professional such as a rifle smith. The Weaver base 80 is attached using techniques which attach the Weaver base 80 to the rifle 2 in a substantially permanent manner with a long axis of the Weaver base 80 precisely parallel to the barrel 8 of the rifle 2, for accurate targeting alignment.

A top 84 of the Weaver base 80 is substantially parallel to the bottom 82 and provides an attachment surface 85 thereon. The attachment surface 85 extends between two ends 86 and between two sides 88. A plurality of teeth 90 and grooves 92 alternate along the attachment surface 85 in a manner similar to that exhibited by the mount teeth 21 and grooves 22 of the auxiliary base 20. However, the teeth 90 and grooves 92 of the Weaver base 80 preferably extend between the ends 86 without interruption and provide a greater number of teeth 90 and grooves 92 than do the auxiliary base 20. Preferably, the teeth 90 and grooves 92 of the Weaver base 80 exhibit a similar size as that exhibited by the mount teeth 21 and grooves 22 of the auxiliary base 20.

Each of the sides 88 of the Weaver base 80 support side lips 84 thereon. Each side lip 84 has a contour including an upper slope 96 and lower slope 98. The side lips 94 have a contour which is substantially identical to the contour of the mount lips 24 of the auxiliary base 20, except that the side lips 94 of the Weaver base 80 are preferably longer than the mount lips 24 of the auxiliary base 20 so that the side lips 94 can extend the entire distance between the ends 86 of the Weaver base 80.

With reference to FIGS. 1–4, details of the connector 40 of the scope mount 10 are described in detail. The connector 40 is oriented beneath the upper surface 14 and adjacent to the lower surface 12, on a side of the lower surface 12 opposite the lower slant 13. The connector 40 includes a planar clamp side 41 oriented perpendicular to both the front end 16, rear end 18 and upper surface 14. The clamp side 41 is oriented on a side of the connector 40 opposite the auxiliary base 20. Preferably, an upper bevel 42 is oriented between the upper surface 14 and the clamp side 41. The upper bevel 42 is preferably angled within a plane which diverges from a plane including the upper surface 14 by an angle γ of approximately 45°. The upper bevel 42 is preferably perpendicular to both the front end 16 and rear end 18.

The clamp side 41 extends down from the upper bevel 42 to a roof 44. The roof 44 is a planar surface substantially parallel to and underlying the upper surface 14. The roof 44 extends away from the clamp side 41 and towards the auxiliary base 20 until it terminates at a side wall 46. The side wall 46 is substantially perpendicular to the upper surface 14 and lower surface 12 and extends from the roof 44 down to the lower surface 12.

A notch 47 is oriented within the side wall 46. The notch 47 includes an upper side 48 and a lower side 49. The notch 47 is sized to receive the side lip 94 on one of the sides 88 of the Weaver base 80 therein, such that the upper side 48 is adjacent the upper slope 96 of one of the side lips 94 and the lower side 49 is adjacent the lower slope 98 of one of the side lips 94. The notch 47 is positioned such that when one of the side lips 94 of the Weaver base 80 is oriented within the notch 47, the attachment surface 85 of the Weaver base 80 is substantially parallel to and adjacent the roof 44 of the connector 40.

The roof 44 has a width similar to a width of the attachment surface 85 of the Weaver base 80, such that the clamp side 41 of the connector 40 is positioned adjacent an upper slope 96 of one of the side lips 94 opposite a side lip 94 oriented within the notch 47, when the connector 40 is overlying the attachment surface 85 of the Weaver base 80. Hence, the connector 40 is provided with a contour which is complemental to the attachment surface 85 of the Weaver base 80, providing the connector 40 with a means to be securely connected to the attachment surface 85 of the Weaver base 80 when the clamp 60 is utilized as described herein below.

With particular reference to FIGS. 1 and 2, the pair of bolts 50 are configured such that a threaded end 58 of each bolt 50 extends perpendicularly out of the clamp side 41 of the connector 40. To position the bolts 50 as desired, a pair of bores 30 are oriented passing through the scope mount 10. Each bore 30 is oriented with a central axis substantially parallel to both the upper surfaces 12, 14 and the front and rear ends 16, 18 and substantially perpendicular to the clamp side 41.

The bore 30 includes a base end 32 which extends out of the auxiliary base 20 preferably through one of the grooves 22. A connector end 34 of the bore 30 preferably extends out of the clamp side 41 of the connector 40. The connector end 34 is preferably only semi-circular and is adjacent a lower end of the clamp side 41. The base end 32 preferably has a greater diameter than the connector end 34 such that a shelf 36 defines a transition between the base end 32 and the connector end 34.

The bolt 50 includes a shaft 52 which has a length similar to an overall length of the scope mount 10. A head 54 is located opposite the threaded end 58. Preferably, the head 54 tappers from having a diameter similar to the shaft 52 adjacent to the shaft 52 to having a greater diameter than the shaft 52 at a distance spaced from the shaft 52. Preferably, a diameter of the shaft 52 is substantially identical to a diameter of the connector end 54 of the bore 30. Hence, the bolt 50 can be driven through the bore 30 from the base end 32 toward the connector end 34, along arrow A, until the head 54 abuts against the shelf 36 within the bore 30. Additional force applied linearly to the bolts 50 can cause the head 54 to deform the shelf 36 slightly and wedge the bolt 54 into place.

In this position within the bore 30, the end 58 of the bolt 50 extends out of the clamp side 41 of the connector 40, exposing threads 56 adjacent the end 58. Should the threads 56 of the bolt 50 become stripped or the bolt 50 become otherwise damaged, the bolt 50 can be driven out of the bore 30 by providing an axial force along the bolt 50 and unwedging the head 54 from the shelf 36 within the bore 30. A replacement bolt 50 can then be driven into the bore 30 and the scope mount 10 provided with a new bolt 50 for continued use.

Figure 4:
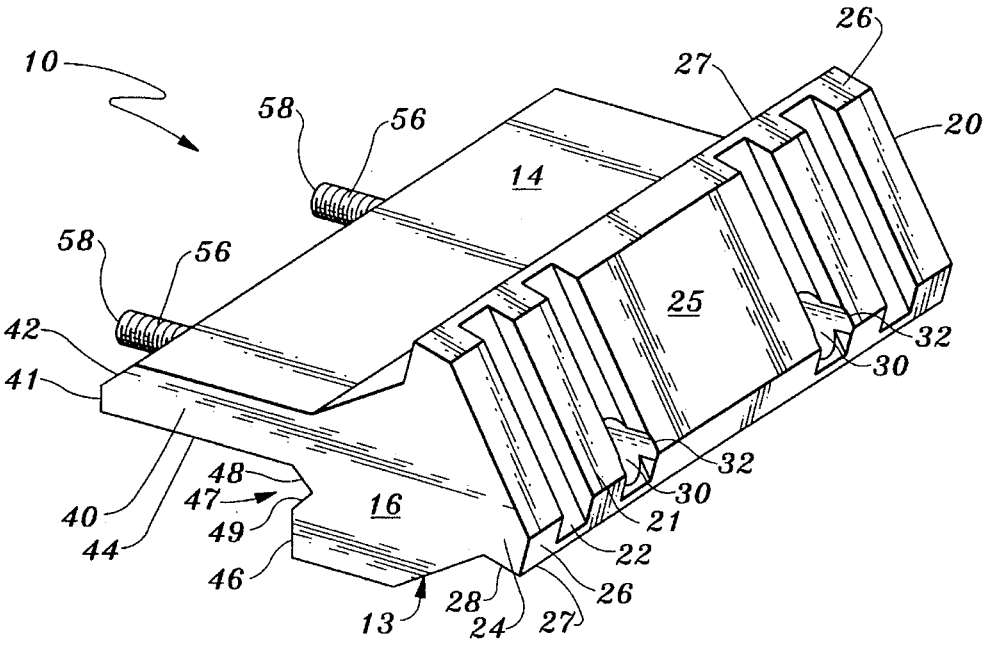
FIG. 4 is a perspective view of that which is shown in FIG. 3 taken from a view point substantially opposite of the view point provided in FIG. 1.

While this form of bolt 50 attachment to the scope mount 10 is preferred, various other systems of bolt 50 attachment could similarly be used, such as providing a blind bore within the scope mount 10 into which the bolts 50 could be threaded. When the bolts 50 are in place within the scope mount 10 the scope mount 10 is provided as substantially as shown in FIGS. 3 and 4.

With reference now to FIGS. 1 and 2, details of the clamp plates 60 and nuts 70 are described in detail. Two clamp plates 60 are provided for connection of the connector 40 to the Weaver base 80. Each clamp plate 60 includes an inner surface 62 parallel to and spaced from an outer surface 64. A hole 65 is provided extending between the inner surface 62 and outer surface 64 substantially perpendicular to the surfaces 62, 64. An upper angle 66 extends away from the inner surface 62 and outer surface 64 at an angle of approximately 45°. A lower angle 68 extends away from a lower portion of the inner surface 62 and outer surface 64 at an angle, matching the angle $\gamma$, of approximately 45°. The upper angle 66 and lower angle 68 both diverge from a plane including the inner surface 62 and outer surface 64 in a common direction.

Preferably, the inner surface 62 has a height greater than a height of the clamp side 41 of the connector 40. Hence, when the clamp plate 60 is oriented with the inner surface 62 adjacent the clamp side 41, the upper angle 66 overlies the upper bevel 42 and the lower angle 68 extends beneath the roof 44 of the connector 40. In this orientation the lower angle 68 creates a recess between the roof 44 and lower angle 68 which mirrors somewhat the orientation of the upper side 48 and lower side 49 of the notch 47 in the side wall 46 opposite the clamp plate 60.

Two nuts 70 are provided which control a position of each clamp plate 60 adjacent the clamp side 41. Each nut 70 includes an outer cylinder 72 and an inner cylinder 76. Preferably a slot 74 is oriented in the outer cylinder 72 to allow the outer cylinder to be easily rotated, about arrow B. The inner cylinder 76 includes a bolt receiver end 78 opposite the outer cylinder 72 which includes threads on an interior thereof which are sized to complementally support the threads 56 of the bolt 50. Hence, when the clamp plates 60 are oriented adjacent the clamp side 41 of the connector 40 with the holes 65 of each clamp plate 60 overlying the bolts 50, the nuts 70 can be threaded onto the threads 56 of the bolts 50 and hold the clamp plates 60 in place adjacent the clamp side 41.

In the this configuration, the clamp plates 60 together with the connector 40 can coact with the side lips 94 of the Weaver base 80 to securely connect the scope mount 10 to the Weaver base 80 of the rifle 2. When the scope mount 10 is to be removed from the Weaver base 80, the nuts 70 can be appropriately rotated, about arrow B, loosening the clamp plates 60 away from the clamp side 41 of the connector 40 and allowing the side lips 94 of the Weaver base 80 to be released. The clamps 60 and nuts 70 thus provide one form of a means to selectively attach and detach the connector 40 to the attachment surface 85 of the Weaver base 80.

Preferably, the bore 30 through the scope mount 10 penetrates the roof 44 of the connector 40 such that the shaft 52 of the bolt 50 extends below the roof 44 of the connector 40. In this way, translation of the scope mount 10 along a long axis of the Weaver base 80 is prevented by the shaft 52 of the bolt 50 abutting the teeth 90 of the attachment surface 85 of Weaver base 80. Hence, in addition to friction generated between the clamp plates 60 and the side lips 94 of the Weaver base 80, the bolt 52 and teeth 90/groove 92 combination of the Weaver base 80 further prevent translation of the scope mount 10 off of the Weaver base 80. By locating each of the bores 30 within grooves 22 of the auxiliary base 20, and positioning the grooves 22 of the auxiliary base 20 spaced apart a similar distance as the grooves 92 of the Weaver base 80, positioning of the bolts 50 within grooves 92 of the Weaver base 80 is assured.

With particular reference now to FIGS. 5–10, details of the operation of the scope mount 10 are provided in detail. Initially, a rifle 2 is configured with a Weaver base 80 affixed to a receiver 4 of the rifle 2. The Weaver base 80 is configured with a long axis thereof parallel to the barrel 8 of the rifle 2 (FIG. 5). Various different scopes can be provided which can connect to the Weaver base 80 such that the scopes are aligned with the barrel 8 of the rifle 2 for accurate targeting.

Figure 6:
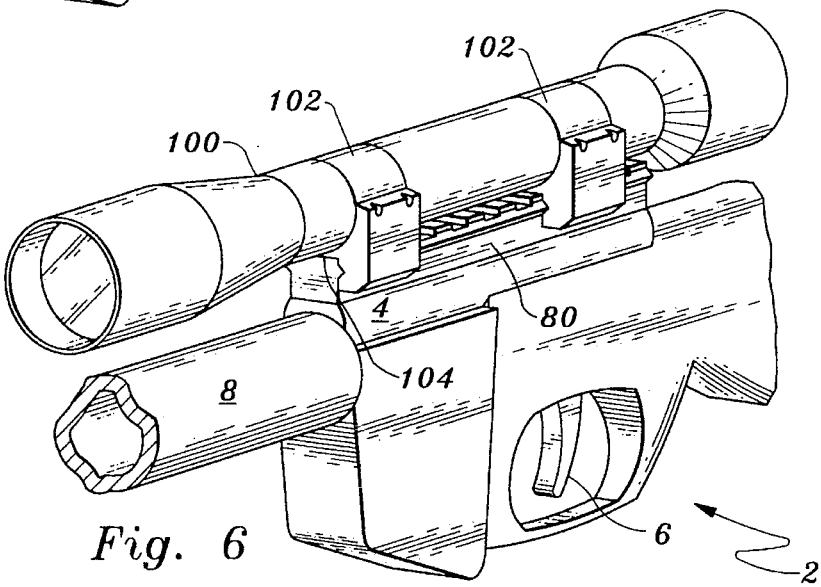
FIG. 6 is a perspective view of that which is shown in FIG. 5 with a high power scope coupled to the Weaver base.
Figure 7:
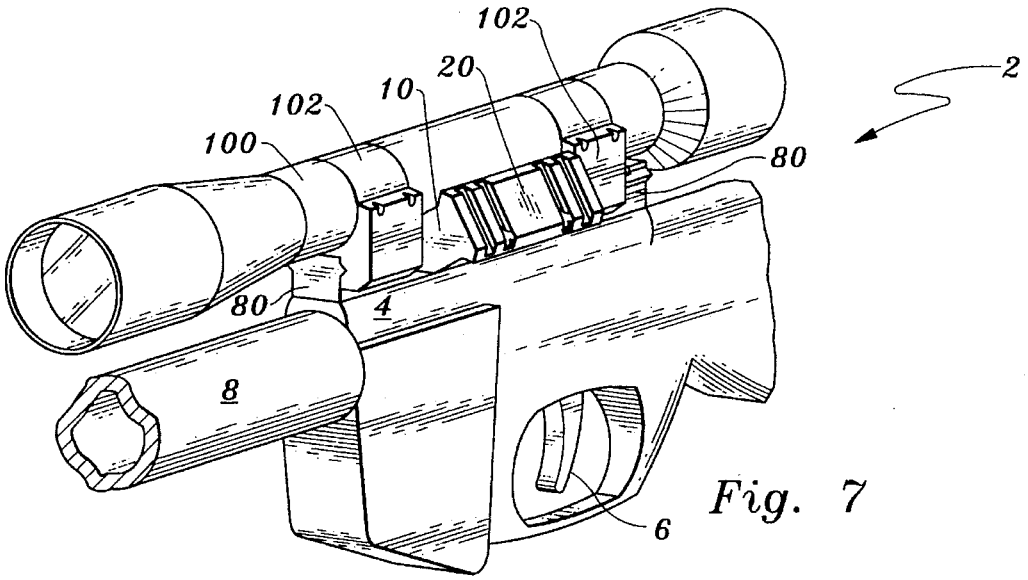
FIG. 7 is a perspective view of that which is shown in FIG. 6 with the multipurpose ambidextrous rifle scope mount of this invention coupled to the Weaver base between the scope rings of the high power scope.

For instance, as shown in FIG. 6, a high power scope 100 can be connected to the Weaver base 80 through two scope rings 102. Each scope ring 102 includes a recess 104 similar to a contour of the connector 40 of the scope mount 10. The recess 104 coacts with a ring clamp 106, ring nut 109 and ring bolt 108 (FIG. 10) to grasp the side lip 94 of the Weaver base 80 and secure the high power scope 100 to the Weaver base 80. Note that the high power scope 100 orients the scope rings 102 near ends 86 of the Weaver base 80 with a significant portion of the Weaver base 80 between the ends 86 unused. The scope mount 10 can be oriented between the scope rings 102 of the high power scope 100 and connected to the attachment surface 85 of the Weaver base 80, as shown in FIG. 7. As shown in FIGS. 1 and 2, the clamp plates 60 are oriented overlying the bolts 50 and adjacent clamp side 41 and the nuts 70 are rotated, about arrow B, until the nuts 70 secure the clamp plates 60 adjacent both the clamp side 41 and one of the side lips 94 of the attachment surface 85 of the Weaver base 80. Once the nuts 70 are tightened, the connector 40 is securely attached to the attachment surface 85 of the Weaver base 80 and the auxiliary base 20 is presented adjacent the high power scope 100 for use in connecting other objects. Note that the auxiliary base 20 is spaced to the side of a vertical plane including the barrel 8 and the long axis of the Weaver base 80.

Other types of scopes are known, such as the auxiliary scope 110, which are particularly suited for targeting objects closer to the rifle 2. The auxiliary scope 110 can be coupled to the auxiliary base 20 of the scope mount 10, as shown in FIG. 8. The auxiliary scope 110 includes scope rings 112 similar to the scope rings 102 which include a recess 114, ring clamps 116 and ring nuts 119 which can coact to connect the scope rings 112, and hence the auxiliary scope 110, to the auxiliary base 20 of the scope mount 10.

When the scope mount 10 is connected to the Weaver base 80, the auxiliary base 20 is oriented with a long axis thereof parallel to a long axis of the attachment surface 85 of the Weaver base 80 and hence parallel to the barrel 8 of the rifle 2. Thus, when the auxiliary scope 110 is attached to the auxiliary base 20, the auxiliary scope 110 is automatically aligned parallel to the barrel 8 of the rifle 2.

The auxiliary base 20 is oriented with its coupling surface 25 in a plane which is angled with respect to the attachment surface 85 of the Weaver base 80. The auxiliary base 20 is also oriented off to a side of the rifle 2 and the Weaver base 80, allowing the auxiliary scope 110 to be coupled to the auxiliary base 20 without interfering with operation of either the high power scope 100 or the rifle 2. Preferably, the auxiliary base 10 has its coupling surface 25 oriented at an angle of approximately 60° with respect to the plane including the attachment surface 85 of the Weaver base 80. This angle has been shown to provide adequate separation between the auxiliary scope 110 and all of the moving parts of the rifle 2, such as clip attachments and shell receivers and rejectors.

If a user prefers to use the auxiliary scope 110 with his right eye, the scope mount 10 is preferably connected to the Weaver base 80 as shown in FIGS. 5–10. Alternatively, if the user prefers use of his left eye with auxiliary scope 110, the scope mount 10 can be removed from the Weaver base 80 and reconnected to the Weaver base 80 on an opposite side of the high power scope 100 in an orientation rotated 180° about a vertical axis with respect to the orientation shown in FIGS. 5–10. Because the scope mount 10 is bilaterally symmetrical about a plane at a mid point between the front end 16 and rear end 18 of the scope mount 10 and parallel to the front end 16 and rear end 18, the scope mount 10 can be oriented either on the left side of the rifle 2 or on the right side of rifle 2 with identical operation. Hence, the scope mount 10 is ambidextrous.

While FIGS. 5–10 show the scope mount 10 supporting an auxiliary scope 110 for use with the high power scope 100, various other objects could replace the scopes 100, 110. For instance, any objects appropriately designed with rings 102, 112 or other similar attachments, such as the connector 40, to facilitate their attachment to the Weaver base 80, could be connected either to the Weaver base 80 directly or to the auxiliary base 20 of the scope mount 10.

While the above specific features of the scope mount 10 are enumerated to provide a detailed description of a preferred embodiment of this invention, various other modifications to the above detailed description can be resorted to without departing from the scope and fair meaning of this invention as described herein above and as claimed herein below in the claims. Hence, this detailed description is not intended to restrict in any way the scope of the claims of this invention.

What is claimed is:

1. A multipurpose mount for a rifle having a rigid rifle base affixed thereon for mounting scopes and other objects thereto, the rifle base having an attachment surface to which the scopes and other objects can be connected, the multipurpose mount comprising in combination:

a connector including means to connect to a portion of the attachment surface of the rifle base, and an auxiliary base, said auxiliary base rigidly connected to said connector and having a coupling surface similar to the attachment surface of the rifle base, such that a scope or other object can be coupled to said coupling surface, and wherein said auxiliary base is spaced from a vertical plane including the long axis of the attachment surface and the barrel of the rifle.

2. A multipurpose mount for a rifle having a rigid rifle base affixed thereon for mounting scopes and other objects thereto, the rifle base having an attachment surface to which the scopes and other objects can be connected, the multipurpose mount comprising in combination:

a connector including means to connect to a portion of the attachment surface of the rifle base, and an auxiliary base, said auxiliary base rigidly connected to said connector and having a coupling surface similar to the attachment surface of the rifle base, such that a scope or other object can be coupled to said coupling surface, wherein said coupling surface includes a long axis parallel to a long axis of the attachment surface of the base when said connector is connected to the rifle base, the long axis of the attachment surface of the base oriented parallel to a barrel of the rifle, such that said long axis of said coupling surface is parallel to the barrel of the rifle, when said connector is connected to the rifle base, and wherein said auxiliary base is spaced from a vertical plane including the long axis of the attachment surface and the barrel of the rifle.

3. The mount of claim 2 wherein said connecter exhibits a cross-sectional contour complemental to a cross-sectional contour of the rifle base and said auxiliary base, facilitating attachment of said connector to the rifle base and attachment of other objects which are designed to be attached to the rifle base to said auxiliary base.

4. The mount of claim 3 wherein said connector has a length parallel to said long axis of said coupling surface which is less than a length of the rifle base, such that when said mount is attached to the rifle base, a portion of the rifle base is not covered by said connector.

5. The mount of claim 4 wherein said means to connect said connector to the attachment surface of the rifle base includes means to selectively attach and detach said connector to the attachment surface of the rifle base.

6. The mount of claim 5 wherein said means to selectively attach and detach said connector includes:

a clamp having an inner surface at least partially facing said cross-sectional contour of said connector, and a means to adjust a location of said clamp toward and away from said cross-sectional contour of said connector, such that said clamp can be caused to capture the attachment surface of the rifle base between said cross-sectional contour of said connector and said clamp, securing said connector to the rifle base.

7. The mount of claim 6 wherein said auxiliary base exhibits lips on opposite sides thereof, said lips substantially parallel to said long axis of said coupling surface, and wherein said connector includes a notch on a portion thereof spaced from and facing said clamp, said notch spaced from a roof of said connector by a distance at least as great as a distance between said lips and said coupling surface.

8. The mount of claim 2 wherein said coupling surface of said auxiliary base is substantially planar with a plurality of mount teeth oriented thereon with grooves between said mount teeth, said coupling surface oriented within a plane which diverges from a plane including the attachment surface of the rifle base by an angle of at least 45°, when said connector of said mount is attached to the attachment surface of rifle base.

9. The mount of claim 7 wherein said cross-sectional contour of said connector includes a side wall having said notch located therein, said side wall adjacent said roof and substantially perpendicular to said side wall, said roof extending to a clamp side of said mount opposite said auxiliary base, said clamp configured to overlie said clamp side of said connector and extend below at least a portion of said roof of said connector with a lower angle portion, said lower angle portion of said clamp extending toward said side wall of said connector a distance sufficient to place at least a portion of said lower angle of said clamp closer to said side wall than said clamp side of said connector, whereby said lower angle of said clamp can cause said connector to be oriented adjacent the attachment surface of the rifle base with one of two side lips of the rifle base oriented within said notch and the other side of the rifle base between said roof of said connector and said lower angle of said clamp.

10. A kit for modifying a rifle to allow attachment of two scopes to the rifle simultaneously, the rifle having a rifle base affixed to a receiver of the rifle with a scope attachment surface thereon, the kit including:

an auxiliary base having a coupling surface with a cross-section similar to a cross-section of the attachment surface, such that a scope can be interchangeably coupled to either the attachment surface or said coupling surface, and a connector rigidly coupling said auxiliary base to a portion of the attachment surface of the rifle base and leaving a remaining portion of the rifle base unobstructed, said connector orienting said auxiliary base parallel to the rifle base, but spaced from the rifle base;

whereby two scopes can be simultaneously coupled to the rifle, one to said coupling surface of said auxiliary base and one to the remaining portion of the attachment surface of the base.

11. The kit of claim 10 wherein said auxiliary base is spaced from said connector in a non-vertical direction, such that said auxiliary base is oriented on a side of the rifle when said connector is oriented on the rifle base, said auxiliary base having a long axis parallel to a long axis at the rifle base.

12. The kit of claim 10 wherein said connector exhibits a cross-section complemental to a cross-section of said auxiliary base and the rifle base, such that said connector can be rigidly coupled to the rifle base and said auxiliary base can be connected to any object which can connect to the rifle base.

13. The kit of claim 10 wherein said connector includes a side wall with a notch therein, said side wall oriented adjacent a roof substantially perpendicular to said side wall, said connector including means to support a clamp adjacent a side of said roof opposite said side wall, said clamp adjustably locatable with respect to said side wall, such that the clamp can be drawn toward and away from said side wall, said clamp having a contour including an upper angle overlying a portion of said connector adjacent said roof and a lower angle extending below said roof and toward said side wall, such that when said clamp is oriented adjacent said roof, a recess is provided between said lower angle and said roof opposite said notch and said side wall, said recess and said notch sized to receive side lips of opposite sides of the rifle base, such that when said clamp is adjacent said roof said connector rigidly connects to said attachment surface of said rifle base.

14. The kit of claim 10 wherein said auxiliary base includes two mount lips, with each mount lip located on a side of said coupling surface of said auxiliary base, said mount lips spaced apart by a distance similar to a distance between side lips of opposite sides of the rifle base, said mount lips having a configuration similar to a configuration of the side lips of the rifle base, such that a scope connectable to the rifle base through the side lips can be connected to said auxiliary base.

15. The kit of claim 14 wherein said coupling surface of said auxiliary base includes a plurality of grooves oriented perpendicular to said long axis of said auxiliary base between said two mount lips, each said groove having a substantially rectangular cross section, and wherein said auxiliary base and connector exhibit a bilaterally symmetrical configuration about a plane perpendicular to said long axis, such that said kit can be connected to the rifle base through said connector in two separate configurations rotated 180° from each other, the two orientations orienting said auxiliary base on opposite sides of the rifle.

16. A method for attaching a second scope to a rifle already having a first scope attached thereto through a rifle base affixed to a rifle, the steps including:

identifying a portion of the rifle base which is not supporting the first scope and is exposed, providing a scope mount having a connector including means to attach to the exposed portion of the rifle base and an auxiliary base rigidly connected to the connector and spaced laterally from the connector, the auxiliary base having a cross-sectional contour similar to a cross-sectional contour of the rifle base, attaching the scope mount to the exposed portion of the rifle base through the connector, in a manner positioning the auxiliary base to a side of a vertical plane including the connector and the rifle base, and attaching the second scope to the auxiliary base with the second scope parallel to the rifle base but spaced laterally from the vertical plane including the connector and the rifle base.

17. The method of claim 16 including the further step of aligning the auxiliary base such that a scope mounted to said auxiliary base is parallel to a barrel of the rifle.

18. The method of claim 16 including the further step of forming the scope mount to be bilaterally symmetrical.

19. The method of claim 16 including the further step of shaping a contour of the connector to be complemental to the rifle base and complemental to the auxiliary base.

* * * * *